US007934294B1

(12) United States Patent
Janes

(10) Patent No.: US 7,934,294 B1
(45) Date of Patent: May 3, 2011

(54) PORTABLE SAFETY HANDLE DEVICE

(76) Inventor: Howard G. Janes, Toronto (CA)

( * ) Notice: Subject to any disclaimer, the term of this patent is extended or adjusted under 35 U.S.C. 154(b) by 379 days.

(21) Appl. No.: 12/266,527

(22) Filed: Nov. 6, 2008

(51) Int. Cl.
*B25G 3/32* (2006.01)

(52) U.S. Cl. ..... 16/422; 16/110.1; 16/426

(58) Field of Classification Search ..... 16/110.1, 16/406, 408, 409, 422, 425, 427, 428, 436, 16/438, 444, 445, DIG. 24, DIG. 40, 413; 211/123; 294/26, 170; 105/354; 296/71; D12/106
See application file for complete search history.

(56) References Cited

U.S. PATENT DOCUMENTS

| | | | | | |
|---|---|---|---|---|---|
| 1,298,144 | A | * | 3/1919 | Yeakel | 294/170 |
| 1,978,960 | A | | 10/1934 | Schlegel | |
| 2,072,118 | A | * | 3/1937 | Claud-Mantle | 105/354 |
| 2,215,870 | A | * | 9/1940 | Claud-Mantle | 105/354 |
| 2,222,950 | A | * | 11/1940 | Itzcovitz et al. | 105/354 |
| 2,500,415 | A | * | 3/1950 | Johnson | 105/354 |
| 3,218,068 | A | * | 11/1965 | Warman | 211/123 |
| 3,286,850 | A | * | 11/1966 | Ruhnke | 211/105.1 |
| 3,378,219 | A | * | 4/1968 | Biesecker | 211/123 |
| 3,582,124 | A | | 6/1971 | Quirk, Jr. | |
| 3,739,920 | A | * | 6/1973 | Coblentz et al. | 211/123 |
| 3,836,174 | A | * | 9/1974 | Holman, Jr. | 211/123 |
| 4,036,424 | A | * | 7/1977 | Thany | 16/406 |
| 4,315,572 | A | * | 2/1982 | Clare | 211/123 |
| 4,494,896 | A | * | 1/1985 | DiFranco | 211/123 |
| 4,502,181 | A | * | 3/1985 | Gonas | 16/445 |
| 4,862,554 | A | * | 9/1989 | Chojnacki | 16/422 |
| 4,912,808 | A | | 4/1990 | Blakely | |
| D317,279 | S | | 6/1991 | Krueger | |
| 5,050,252 | A | * | 9/1991 | Cuttriss | 211/105.2 |
| 5,415,299 | A | * | 5/1995 | Usner | 211/123 |
| 5,493,756 | A | * | 2/1996 | Shanok et al. | 16/444 |
| 5,732,442 | A | | 3/1998 | Haggard | |
| D407,293 | S | * | 3/1999 | Haggard | D12/106 |
| 6,131,979 | A | | 10/2000 | McGhee | |
| 6,895,867 | B1 | * | 5/2005 | Burrows | 105/375 |
| 7,086,544 | B1 | * | 8/2006 | Doench | 211/123 |
| 2005/0066479 | A1 | * | 3/2005 | Kim et al. | 16/436 |

* cited by examiner

*Primary Examiner* — Victor Batson
*Assistant Examiner* — Jeffrey O'Brien

(57) ABSTRACT

A safety handle device for attaching to a wall of a trailer to allow a user to enter a trailer comprising a bar; a channel disposed in the bar near the first end; a sliding component slidably disposed in the channel; a first ring rotatably attached to the sliding component; an anchor component fixedly attached to the bar near the second end; a second ring rotatably attached to the anchor component; a first strap attached to the first ring and a second strap attached to the second ring; an E-clip attached to each of the first strap and the second strap; wherein the E-clip is insertable into an E-channel disposed on the wall of the trailer.

6 Claims, 5 Drawing Sheets

PORTABLE SAFETY HANDLE DEVICE

FIELD OF THE INVENTION

The present invention is directed to a portable handle for facilitating entry into and exit from a trailer.

BACKGROUND OF THE INVENTION

Van trailers are often used to transport goods and animals on the open road. Such trailers, which come in various shapes and sizes, are generally hauled by trucks or tractors. A typical van trailer includes a large interior fully enclosed by a metal body. Access to the interior of the trailer is gained by way of one or more doors in the trailer body. For example, many van trailers include a pair of rear cargo doors pivotally mounted in a vertical orientation to the side walls of the trailer body.

Getting in and out of many van trailers is a difficult task. A large number of van trailers are designed for use with loading docks and do not include ramps or steps to facilitate access. In order to enter such a trailer from the ground; one must grab the slick floor and try to balance him or herself while climbing on to the rear bumper and into the trailer. Many individuals have slipped and sustained serious injuries this way. The present invention features a portable safety handle device for facilitating entry into and exit from a trailer.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
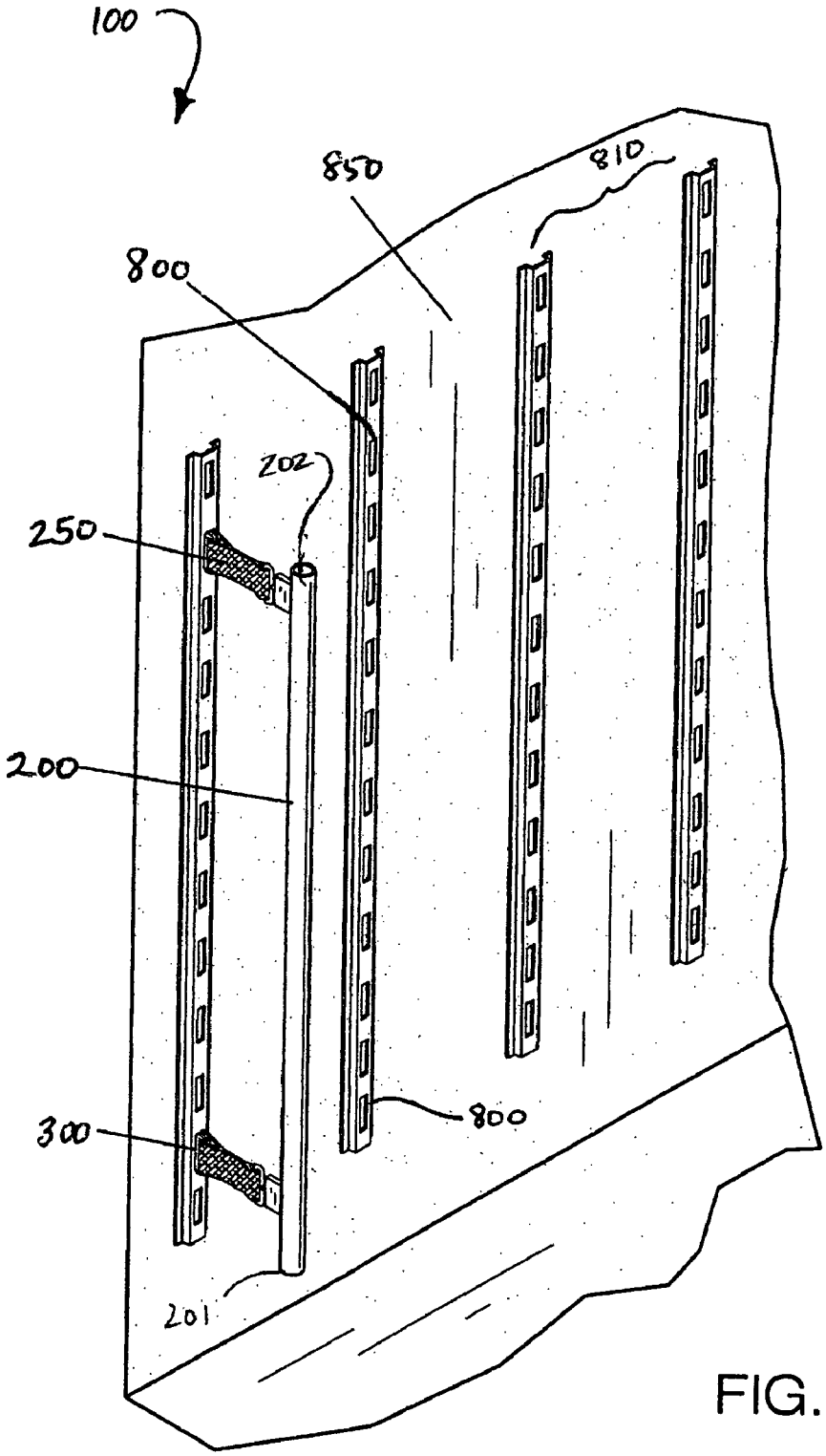
FIG. 1 is a perspective view of the safety handle device of the present invention.

Referring now to FIGS. 1-4, the present invention features a portable safety handle device 100 for attaching to the rear wall 850 or side wall 850 of a trailer. The safety handle device 100 is for allowing a user to climb in and out of the cargo space of a trailer.

The safety handle device 100 comprises a generally hollow bar 200 (e.g., a rod) having a first end 201, a second end 202, and an inside. Disposed in the bar 200 is a channel 700 for providing access to the inside of the bar 200. In some embodiments, the channel 700 is disposed near the first end 201 of the bar 200.

A sliding component 120 having a first end 121 and a second end 122 is slidably disposed in the channel 700 of the bar 200 such that it can slide up and down the length of the channel 700. For example, the first end 121 of the sliding component 120 is slidably disposed in the channel 700 of the bar 200. The sliding component 120 can be moved up and down the length of the channel 700 to allow a user to configure the safety handle device according to his/her needs for optimum positioning.

Figure 3:
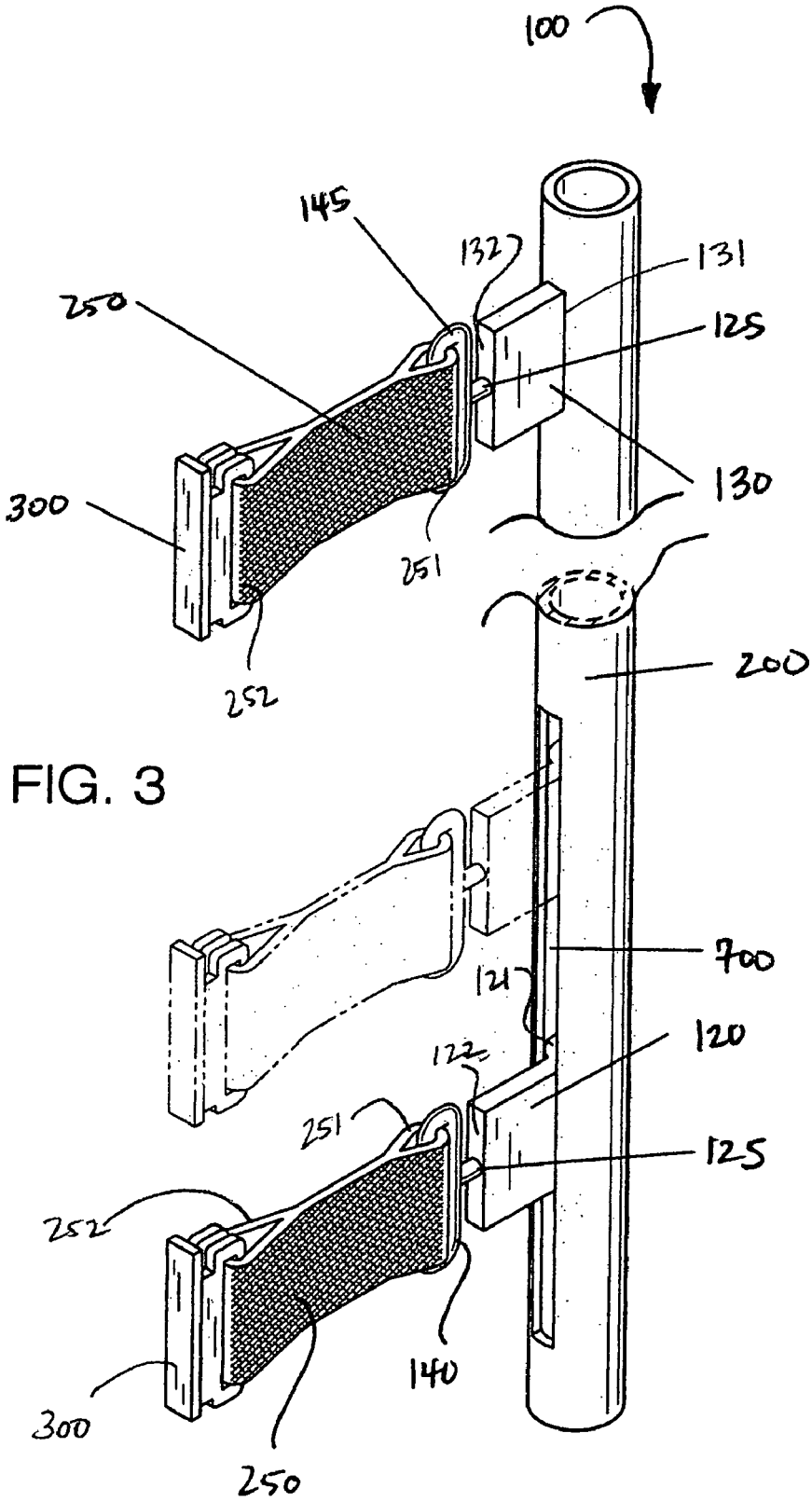
FIG. 3 is a perspective view of the safety handle device of the present invention.
Figure 4:
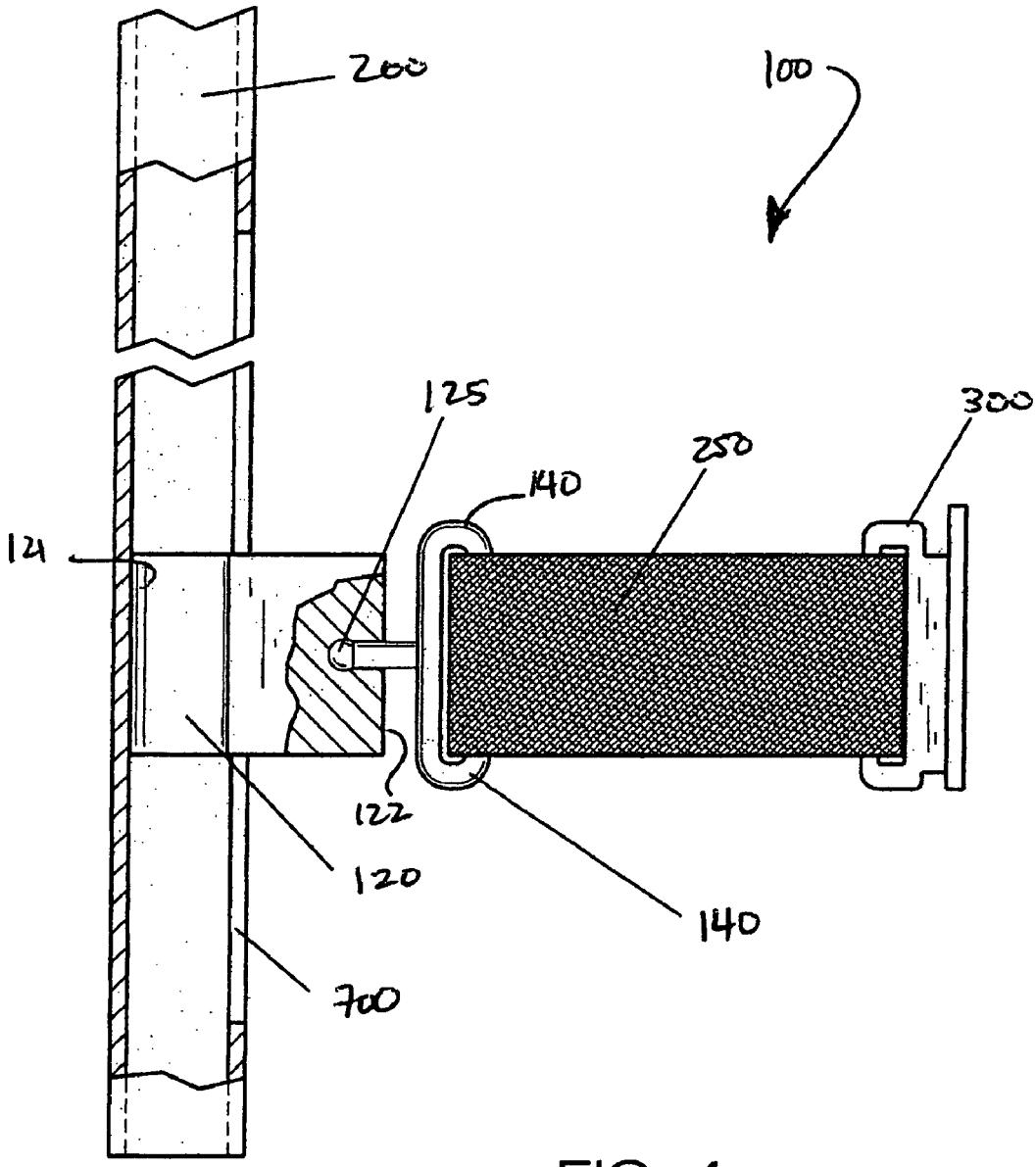
FIG. 4 is a side and cross sectional view of the safety handle device of the present invention.
Figure 5:
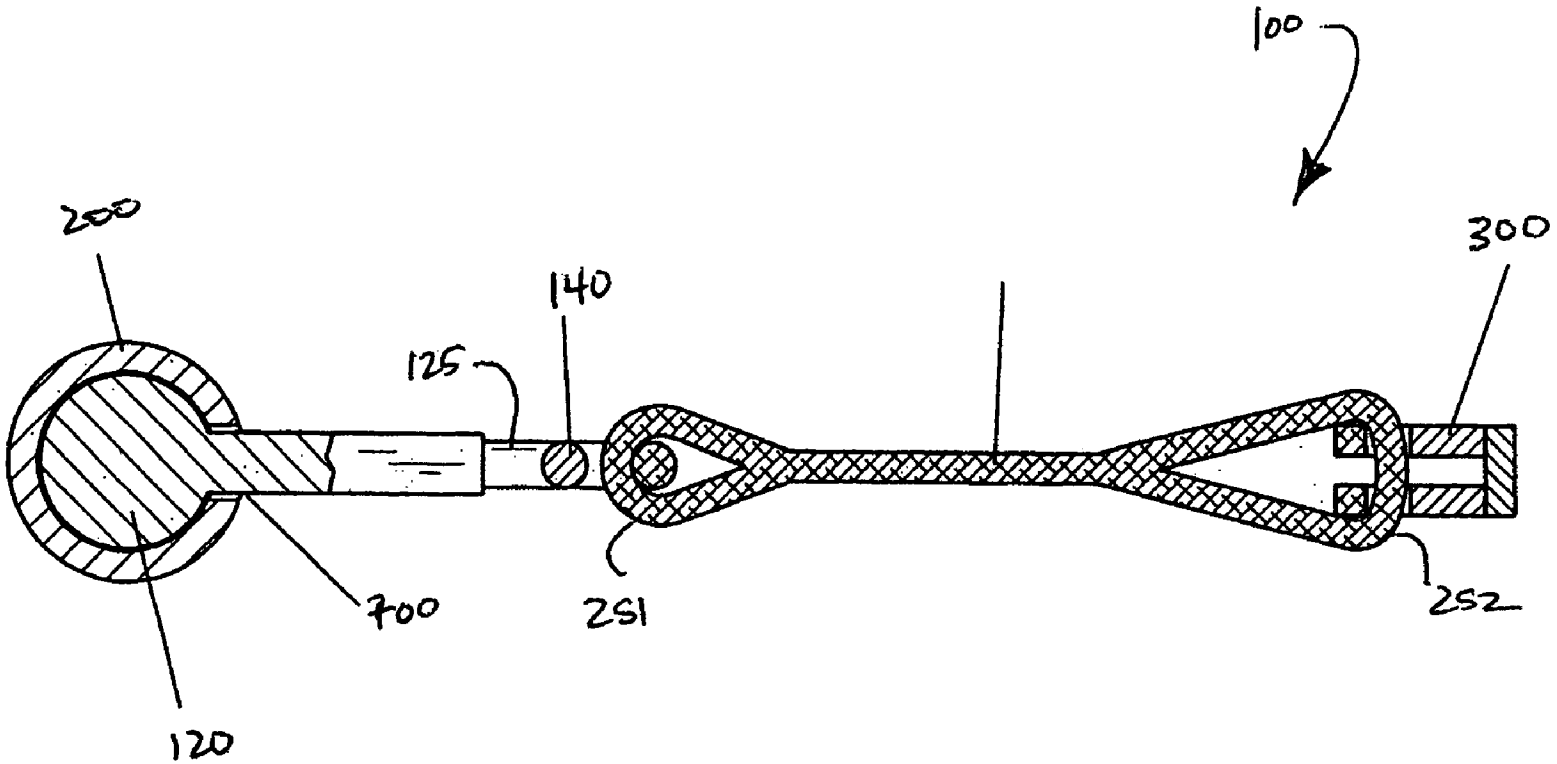
FIG. 5 is a top and cross sectional view of the safety handle device of the present invention.

A first ring 140 is pivotally and rotatably attached to the second 122 end of the sliding component 120 via a rotating component 125 (see FIG. 3). In some embodiments, the rotating component 125 is rotatable such that the first ring 140 may be rotated 360 degrees. Rotating the first ring 140 allows the bar 200 to be attached vertically or horizontally on the trailer wall 850.

A strap 250 (e.g., first strap) having a first end 251 and a second end 252 is attached to the first ring 140. The first end 251 of the strap 250 (e.g., first strap) is attached to the first ring 140; an E-clip 300 is attached to the second end 252 of the strap 250 (e.g., first strap).

Disposed near the second end 202 of the bar 200 is an anchor component 130 having a first end 131 and a second end 132. The anchor component 130 is similar to the sliding component 120, but the anchor component 130 does not slide. The first end 131 of the anchor component 130 is fixedly attached to the bar 200.

A second ring 145 is pivotally and rotatably attached to the second 132 end of the anchor component 130 via a rotating component 125 (see FIG. 3). In some embodiments, the rotating component 125 is rotatable such that the second ring 145 may be rotated 360 degrees. Rotating the second ring 145 allows the bar 200 to be attached vertically or horizontally on the trailer wall 850.

A strap 250 (e.g., second strap) having a first end 251 and a second end 252 is attached to the second ring 145. The first end 251 of the strap 250 (e.g., second strap) is attached to the second ring 145; an E-clip 300 is attached to the second end 252 of the strap 250 (e.g., second strap).

Figure 2:
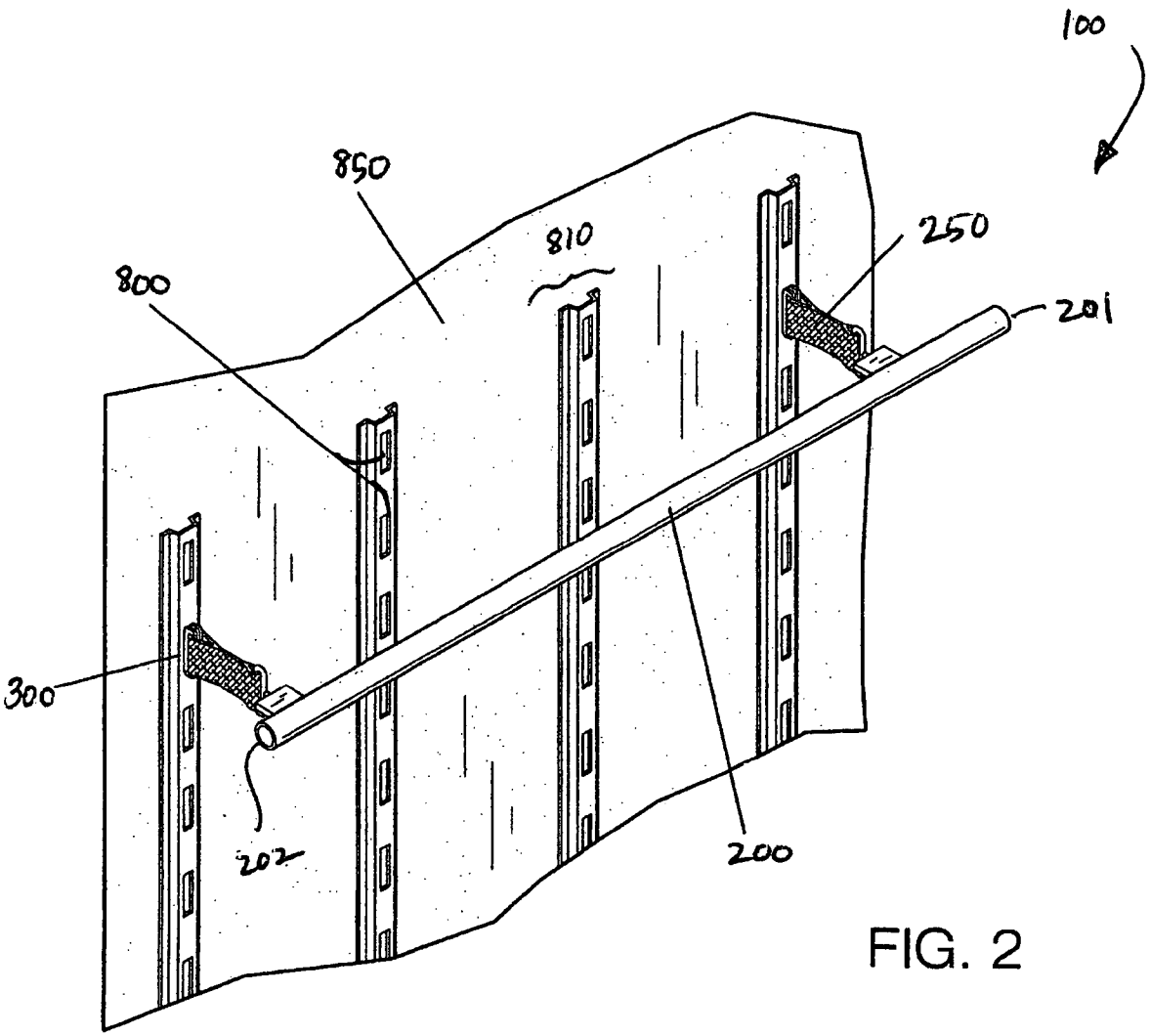
FIG. 2 is a perspective view of the safety handle device of the present invention.

The E-clips 300 are insertable into an E-channel 800. In some embodiments, a panel 810 of E-channels 800 is disposed on a rear wall 850 or side wall 850 of a trailer (e.g., see. FIG. 1, FIG. 2). A user can insert the E-clips 300 attached to the straps 250 in any E-channel 800. This locks the bar 200 in place such that it can be used as a safe and sturdy means of lifting oneself into the trailer. Such E-channels 800 and panels 810 are well known to one of ordinary skill in the art.

The safety handle device 100 may be constructed from a variety of materials. For example, in some embodiments, the bar 200 is constructed from a material comprising steel and/or the like.

As used herein, the term "about" refers to plus or minus 10% of the referenced number. For example, an embodiment wherein the bar 200 is about 30 inches long includes a bar 200 between 27 and 33 inches long.

The safety handle device 100 may be constructed in a variety of shapes and/or sizes. For example, in some embodiments, the bar 200 is cylindrical. In some embodiments, the diameter of the bar 200 is between about 1.0 to 1.5 inches. In some embodiments, the diameter of the bar 200 is between about 1.5 to 2.0 inches.

In some embodiments, the bar 200 is between about 12 to 24 inches in length as measured from the first end 201 to the second end 202. In some embodiments, the bar 200 is between about 24 to 36 inches in length as measured from the first end 201 to the second end 202. In some embodiments, the bar 200 is between about 36 to 48 inches in length as measured from the first end 201 to the second end 202.

Example 1

Use of the Safety Handle Device

The following example describes the use of the portable safety handle device 100 of the present invention. A user (e.g., truck driver) wishes to access the back of his parked trailer. First, he swings open the back doors. Next, the user hooks in the E-clip 300 connected to the first ring 140 into an E-channel 810 in the inside of the trailer door 850. The user then steps up onto the bumper of the trailer to reach up and clip in the other E-clip 300 connected to the second ring 145 into an E-channel 800. Once the safety handle device 100 is installed, the driver grasps the bar 200 and easily steps up and into the rear freight space of the trailer without any struggling, slipping, or falling.

The following the disclosures of the following U.S. patents are incorporated in their entirety by reference herein: U.S. Pat. No. 1,978,960; U.S. Pat. No. 6,131,979; U.S. Pat. No. 4,912,808; U.S. Pat. No. 3,582,124; U.S. Pat. No. 5,732,422.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A portable safety handle device for attaching to a wall of a trailer, said safety handle device comprising:

(a) a generally hollow bar having a first end, a second end, and an inside;

(b) a channel disposed in the bar near the first end, wherein the channel is for providing access into the Inside of the bag (c) a sliding component having a first end and a second end slidably disposed in the channel of the bar such that the sliding component can slide up and down a length of the channel;

(d) a first ring pivotally and rotatably attached to the second end of the sliding component via a: rotating component; wherein the rotating component is rotatable such that the first ring can rotate 360 degrees;

(e) an anchor component disposed near the second end of the bar, said anchor component having a first end and a second end; wherein the first end of the anchor component is fixedly attached to the bag (f) a second ring pivotally and rotatably attached to the second end of the anchor component via a rotating component wherein the rotating component is rotatable such that the second ring can rotate 360 degrees;

(g) a first strap having a first end and a second end; wherein the first end of the first strap is attached to the first ring;

(h) a second strap having a first end and a second end; wherein the first end of the second strap is attached to the second ring;

(i) an E-clip attached to each of the second end of the first strap and the second end of the second strap; wherein each E-clip is insertable into an E-channel disposed in a panel of E-channels on the wall of the trailer; wherein the E0clip allows the bar to be locked in place on the wall of the trailer;

wherein the portable safety handle device allows a user to climb in and out of the cargo space of a trailer.

2. The safety handle device of claim 1, wherein the bar is constructed from a material comprising steel.

3. The safety handle device of claim 1, wherein the bar is between about 1.0 to 2.0 inches in diameter.

4. The safety handle device of claim 1, wherein the bar is between about 12 to 24 inches in length as measured from the first end to the second end.

5. The safety handle device of claim 1, wherein the bar is between about 24 to 36 inches in length as measured from the first end to the second end.

6. The safety handle device of claim 1, wherein the bar is between about 36 to 48 inches in length as measured from the first end to the second end.

* * * * *